US007150823B2

(12) United States Patent
Mayer et al.

(10) Patent No.: US 7,150,823 B2
(45) Date of Patent: Dec. 19, 2006

(54) CATALYTIC FILTERING OF A FISCHER-TROPSCH DERIVED HYDROCARBON STREAM

(75) Inventors: Jerome F. Mayer, Novato, CA (US); Andrew Rainis, Walnut Creek, CA (US); Richard O. Moore, Jr., San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 121 days.

(21) Appl. No.: 10/613,058

(22) Filed: Jul. 2, 2003

(65) Prior Publication Data

US 2005/0004414 A1 Jan. 6, 2005

(51) Int. Cl.
*C10G 45/04* (2006.01)

(52) U.S. Cl. ..... 208/251 R; 208/252; 208/253; 208/251 H

(58) Field of Classification Search ..... 208/251 R, 208/252, 253, 251 H
See application file for complete search history.

(56) References Cited

U.S. PATENT DOCUMENTS

| | | | | |
|---|---|---|---|---|
| 2,852,546 | A | 9/1958 | Kolling et al. | |
| 2,877,257 | A | 3/1959 | Cain et al. | |
| 3,966,596 | A | 6/1976 | Stevens et al. | |
| 4,101,460 | A | 7/1978 | Small et al. | |
| 4,347,121 | A | 8/1982 | Mayer et al. | |
| 4,477,597 | A | 10/1984 | Lee et al. | |
| 4,568,663 | A | 2/1986 | Mauldin | |
| 4,684,756 | A * | 8/1987 | Derr et al. | 585/330 |
| 4,724,082 | A | 2/1988 | Boom | |
| 4,810,357 | A | 3/1989 | Chester et al. | |
| 4,874,733 | A | 10/1989 | Miller et al. | |
| 4,976,848 | A | 12/1990 | Johnson | |
| 4,983,560 | A | 1/1991 | Copperthwaite et al. | |
| 5,019,543 | A | 5/1991 | Davis | |
| 5,183,561 | A * | 2/1993 | Kresge et al. | 208/251 R |
| 5,378,348 | A | 1/1995 | Davis et al. | |
| 5,486,542 | A | 1/1996 | Posthuma et al. | |
| 5,900,159 | A | 5/1999 | Engel et al. | |
| 5,989,412 | A * | 11/1999 | Okagami et al. | 208/251 H |
| 6,179,995 | B1 | 1/2001 | Cash et al. | |
| 6,359,018 | B1 | 3/2002 | O'Rear et al. | |
| 6,476,086 | B1 | 11/2002 | Zhou | |
| 2002/0035163 | A1 | 3/2002 | Vogel et al. | |

FOREIGN PATENT DOCUMENTS

| | | | |
|---|---|---|---|
| CN | 1401427 | A * | 3/2003 |
| EP | 0579330 | B1 | 1/1994 |
| EP | 0609079 | | 8/1994 |
| EP | 0921184 | A1 | 6/1999 |
| WO | WO 00/11113 | | 3/2000 |
| WO | WO 02/07883 | A2 | 1/2002 |
| WO | 03/012008 | | 2/2003 |
| WO | WO03/013725 | A1 | 2/2003 |

OTHER PUBLICATIONS

U.S. Appl. No. 10/613,423 Moore, et al., *Distillation of a Fischer-Tropsch Derived Hydrocarbon Stream* filed on Jul. 2, 2003.

(Continued)

*Primary Examiner*—Tam M. Nguyen
(74) *Attorney, Agent, or Firm*—Buchanan Ingersoll PC

(57) ABSTRACT

Novel methods of treating a Fischer-Tropsch derived hydrocarbon stream with an active filtering catalyst are disclosed. Such methods are capable of removing soluble (and ultra-fine particulate) contamination, fouling agents, and/or plugging precursors from the Fischer-Tropsch derived hydrocarbon stream such that plugging of the catalyst beds of a subsequent hydroprocessing process is substantially avoided.

22 Claims, 3 Drawing Sheets

OTHER PUBLICATIONS

U.S. Appl. No. 10/613,422 Ball, et al., *Acid Treatment of a Fischer-Tropsch Derived Hydrocarbon Stream* filed on Jul. 2, 2003.

U.S. Appl. No. 10/613,421 Bull, et al., *Ion Exchange Methods of Treating a Fischer-Tropsch Derived Hydrocarbon Stream* filed on Jul. 2, 2003.

Bala, P., et al., "Dehydration Transformation in Ca-Montmorillonite", *Bull. Mater. Sci.* 23(1): 61-67 (2000).

International Search Report dated Nov. 16, 2004.

Netherlands Search Report dated Aug. 9, 2005.

* cited by examiner

Removal of Aluminum from F-T Wax Using Alundum and Active Catalysts

CATALYTIC FILTERING OF A FISCHER-TROPSCH DERIVED HYDROCARBON STREAM

REFERENCE TO RELATED APPLICATIONS

The present application hereby incorporates by reference in its entirety U.S. patent application Ser. No. 10/613,423, entitled "Distillation of a Fischer-Tropsch Derived Hydrocarbon Stream," by Richard O. Moore, Jr., Donald L. Kuehne, and Richard E. Hoffer; U.S. patent application Ser. No. 10/613,422, entitled "Acid Treatment of a Fischer-Tropsch Derived Hydrocarbon Stream," by Lucy M. Bull, William Schinski, Donald L. Kuehne, Rudi Heydenrich, and Richard O. Moore, Jr.; and U.S. patent application Ser. No. 10/613,421, entitled "Ion Exchange Methods of Treating a Fischer-Tropsch Derived Hydrocarbon Stream," by Lucy M. Bull and Donald L. Kuehne.

BACKGROUND OF THE INVENTION

1. Field of the Invention

The present invention relates in general to the processing of products from a Fischer-Tropsch synthesis reaction. More specifically, embodiments of the present invention are directed to the use of an active catalyst for effectively removing contamination from the Fischer-Tropsch derived hydrocarbon stream prior to sending that stream on to additional processing.

2. State of the Art

The majority of the fuel used today is derived from crude oil, and crude oil is in limited supply. However, there is an alternative feedstock from which hydrocarbon fuels, lubricating oils, chemicals, and chemical feedstocks may be produced; this feedstock is natural gas. One method of utilizing natural gas to produce fuels and the like involves first converting the natural gas into an "intermediate" known as syngas (also known as synthesis gas), a mixture of carbon monoxide (CO) and hydrogen ($H_2$), and then converting that syngas into the desired liquid fuels using a process known as a Fischer-Tropsch (FT) synthesis. A Fischer-Tropsch synthesis is an example of a so-called gas-to-liquids (GTL) process since natural gas is converted into a liquid fuel. Typically, Fischer-Tropsch syntheses are carried out in slurry bed or fluid bed reactors, and the hydrocarbon products have a broad spectrum of molecular weights ranging from methane ($C_1$) to wax ($C_{20+}$).

The Fischer-Tropsch products in general, and the wax in particular, may then be converted to products including chemical intermediates and chemical feedstocks, naphtha, jet fuel, diesel fuel, and lubricant oil basestocks. For example, the hydroprocessing of Fischer-Tropsch products may be carried out in a trickle flow, fixed catalyst bed reactor wherein hydrogen ($H_2$), or a hydrogen enriched gas, and the Fischer-Tropsch derived hydrocarbon stream comprise the feed to the hydroprocessing reactor. The hydroprocessing step is then accomplished by passing the Fischer-Tropsch derived hydrocarbon stream through one or more catalyst beds within the hydroprocessing reactor, along with a stream of the hydrogen enriched gas.

In some cases, the feeds to be hydroprocessed contain contaminants that originate from upstream processing. These contaminants may take either a soluble or particulate form, and include catalyst fines, catalyst support material and the like, and rust and scale from upstream processing equipment. Fischer-Tropsch wax and heavy products, especially from slurry and fluid bed processes, may contain particulate contaminants (such as catalyst fines) that are not adequately removed by filters provided for that purpose. The removal of those particulates prior to hydroprocessing may be complicated by the potentially high viscosities and temperatures of the wax stream leaving the Fischer-Tropsch reactor.

The typical catalyst used in a hydroprocessing reactor demonstrates a finite cycle time; that is to say, a limited time (or amount) of usefulness before it has to be replaced with a new catalyst charge. The duration of this cycle time usually ranges from about six months to four years or more. It will be apparent to one skilled in the art that the longer the cycle time of a hydroprocessing catalyst, the better the economics of the plant.

Soluble and/or particulate contaminants can create serious problems if they are introduced into the hydroprocessing reactor with the feed. The soluble contaminants pose a problem when, under certain conditions of hydroprocessing, they precipitate out of solution to become particulates. The contamination can cause partial or even complete plugging of the flow-paths through the catalyst beds as the contamination accumulates on the surfaces and interstices of the catalyst. In effect, the catalyst pellets filter out particulate contamination from the feed. In addition to trapping debris that is entrained in the feed, the catalyst beds may also trap reaction by-products from the hydroprocessing reaction itself, an example of such a reaction by-product being coke. Plugging can lead to an impairment of the flow of material through the catalyst bed(s), and a subsequent buildup in the hydraulic pressure-drop across the reactor (meaning the pressure differential between the ends of the reactor where the entry and exit ports are located, respectively). Such an increase in pressure-drop may threaten the mechanical integrity of the hydroprocessing reactor internals.

There are at least two potentially undesirable consequences of catalyst bed plugging. One is a decrease in reactor throughput. A more serious consequence is that a complete shut down of the reactor may be required to replace part or all of the catalyst charge. Either of these consequences can have a negative effect on operating plant economics.

Prior art attempts to manage the problem of catalyst bed plugging in hydroprocessing reactors have been directed toward eliminating at least a portion of the particulate contamination in the feed by filtering the feed prior to its introduction to the hydroprocessing reactor. Such conventional filtration methods are usually capable of removing particulates larger than about 1 microns in diameter. Other prior art methods have been directed toward either controlling the rate of coking on the hydroprocessing catalyst, selecting a feed that is not likely to produce coke, or judiciously choosing the hydroprocessing conditions (conditions such as hydrogen partial pressure, reactor temperature, and catalyst type) that affect coke formation.

The physical removal of fouling contamination, based on the shape of a guard bed particle, is known in the art. For example, PCT publication WO 03/013725 discloses that a particular particle having three protrusions, each protrusion running along the entire length of the particle, is useful in a guard bed to capture fouling. However, such methods do not appear to teach the removal of ultrafine and soluble contamination based on the use of catalytically active metals.

The present inventors have found that the above-mentioned open art methods are not effective at removing very small sized particle (or soluble) contaminants, fouling agents, and/or plugging-precursors (hereinafter referred to as "contamination") from the feedstream to a hydroprocessing reactor when that feedstream comprises a Fischer-Tropsch derived hydrocarbon stream. This is particularly true when the Fischer-Tropsch derived hydrocarbon stream is a wax produced by a slurry bed or fluid bed process. Typical open art methods have therefore not been found to be effective at avoiding the pressure-drop buildup in a hydroprocessing, hydroisomerization, or hydrotreating reactor when that buildup is caused either by particulate contamination, or by soluble contamination that precipitates out of solution.

The apparent failure of typical open art methods has been attributed to either the presence in the hydroprocessing reactor feed of finely divided, solid particulates with diameters of less than about one micron, and/or to a soluble contaminant, possibly having a metallic component, with the ability to precipitate out of solution adjacent to or within the hydroprocessing reactor catalyst beds. What is needed is a method of removing particulates, contaminants, soluble contamination, fouling agents, and plugging precursors from the feedstream to a hydroprocessing reactor such that pressure drop buildup within the hydroprocessing reactor is substantially avoided.

SUMMARY OF THE INVENTION

A Fischer-Tropsch synthesis is an example of a so-called gas-to-liquids (GTL) process, where natural gas is first converted into syngas (a mixture substantially comprising carbon monoxide and hydrogen), and the syngas is then converted into the desired liquid fuels. Typically, Fischer-Tropsch syntheses are carried out in slurry bed or fluid bed reactors, and the hydrocarbon products have a broad spectrum of molecular weights ranging from methane ($C_1$) to wax ($C_{20+}$). The Fischer-Tropsch products in general, and the wax in particular, may then be hydroprocessed to form products in the distillate fuel and lubricating oil range. According to embodiments of the present invention, hydroprocessing may be conducted in either an upflow or downflow mode. The present process is particularly applicable to operation in the downflow mode.

In some cases, the feeds to be hydroprocessed contain contamination that originates from upstream processing. This contamination may include catalyst fines, catalyst support material and the like, and rust and scale from upstream processing equipment. Fischer-Tropsch wax and heavy products, especially from slurry and fluid bed processes, may contain contamination (such as catalyst fines) that is not adequately removed by filters provided for that purpose. Contamination can create a serious problem if it is introduced into the hydroprocessing reactor with the feed. The contamination can cause partial or even complete plugging of the flow-paths through the catalyst beds as the contamination accumulates on the surfaces and interstices of the catalyst.

The present inventors have found new methods that are effective at removing contamination, which may include particulates, solidified contaminants, soluble contamination, fouling agents, and/or plugging-precursors from the feed stream to a hydroprocessing reactor when that feed comprises a Fischer-Tropsch derived hydrocarbon stream. The consequences of contamination in the Fischer-Tropsch derived hydrocarbon stream typically include a pressure-drop buildup in the hydroprocessing reactor.

In one embodiment of the present invention, contamination is removed from a Fischer-Tropsch derived hydrocarbon stream using the steps:

a) filtering a Fisher-Tropsch derived hydrocarbon stream to produce a filtered hydrocarbon stream;

b) passing the filtered hydrocarbon stream to a catalytic filtering zone, the catalytic filtering zone containing a catalyst comprising at least one metal selected from the group consisting of Group VI and Group VIII elements at conditions sufficient to remove at least a portion of the contamination from the filtered hydrocarbon stream, thus forming a purified hydrocarbon stream;

c) passing the purified hydrocarbon stream to a hydroprocessing zone; and d) recovering at least one fuel product from the hydroprocessing zone.

In another embodiment of the present invention, the temperature of the hydroprocessing zone is less than the temperature of the catalytic filtering zone. The present methods may further include the step of cooling the purified hydrocarbon stream to produce a purified and cooled hydrocarbon stream, and passing the purified and cooled hydrocarbon stream to the hydroprocessing zone.

The contamination being removed from the Fischer-Tropsch derived hydrocarbon stream may comprise an inorganic component selected from the group consisting of Al, Co, Ti, Fe, Mo, Na, Zn, Si, and Sn, and it may originate from processing equipment that is upstream from the hydroprocessing reactor. According to some embodiments of the present invention, the contamination originates from the catalyst(s) used to produce the Fischer-Tropsch derived hydrocarbon stream.

In another embodiment of the present invention, the catalytic filtering zone is maintained at a temperature greater than about 450° F. In yet another embodiment, the catalytic filtering zone is maintained at a temperature greater than about 700° F. Furthermore, the catalytic filtering zone may be maintained with a hydrogen-containing atmosphere having a pressure of greater than about 500 psig. The catalytic filtering zone and the hydroprocessing zone can be configured to reside within a single reactor.

Present methods may further include an acid treatment step that comprises contacting the filtered hydrocarbon stream with an aqueous acidic stream, a distillation step that includes passing the filtered hydrocarbon stream to at least one distillation step, and an ion exchange treatment step in which the filtered stream is contacted with a clay or an ion exchange resin.

An advantage of the present methods is that plugging of catalyst beds that otherwise would have been caused by contamination in the conventionally filtered Fischer-Tropsch derived hydrocarbon stream is substantially avoided by passing a purified hydrocarbon stream to the hydroprocessing zone.

DETAILED DESCRIPTION OF THE INVENTION

Figure 1:
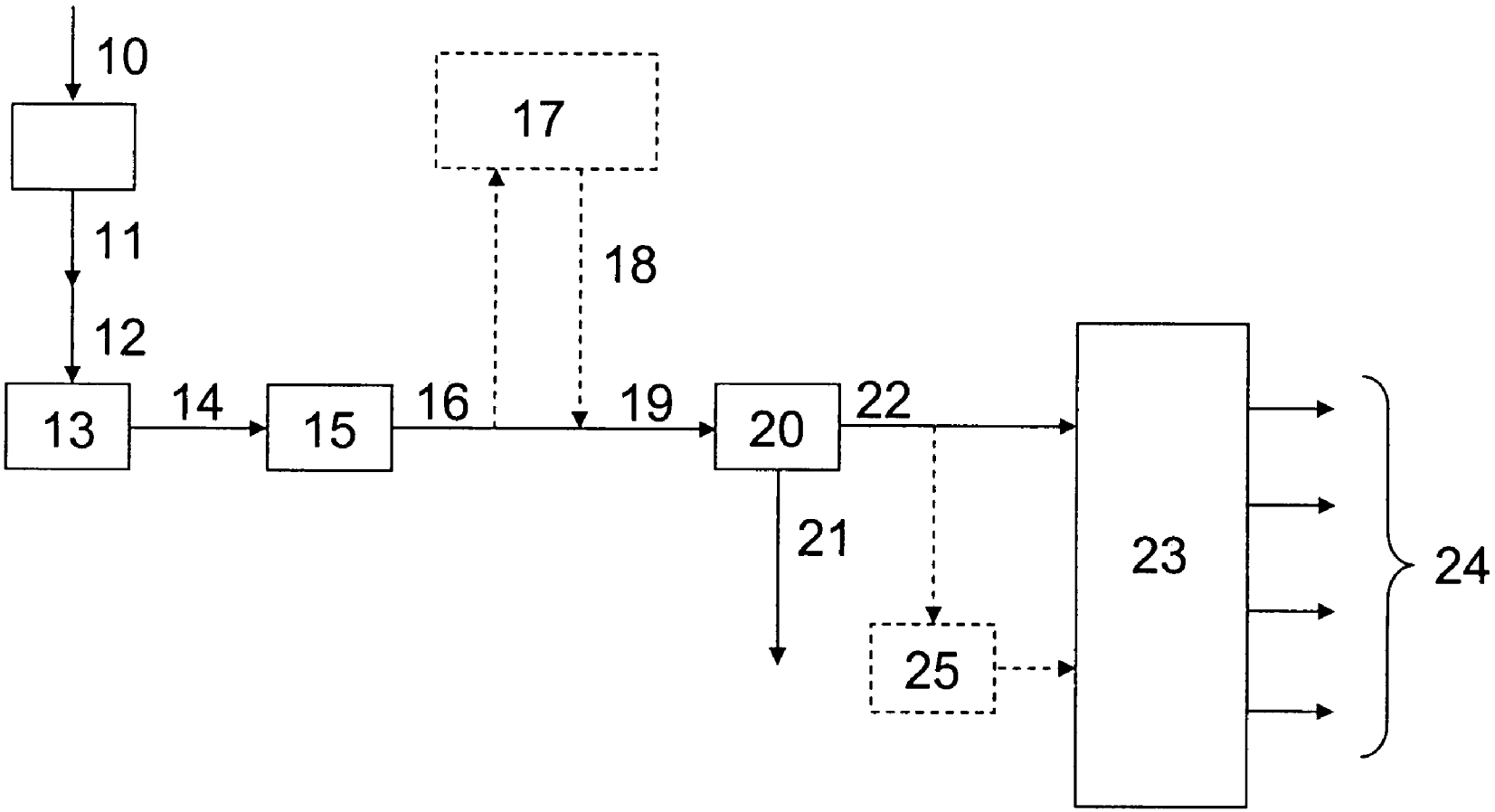
FIG. 1 is an overview of the present process in which the products of a Fischer-Tropsch synthesis reaction are conventionally filtered, and then subjected to a catalytic filtering step at conditions sufficient to remove contamination prior to sending the resulting purified hydrocarbon stream on to hydroprocessing.

Embodiments of the present invention are directed to the hydroprocessing of products from a Fischer-Tropsch synthesis reaction. The present inventors have observed under certain conditions a tendency for the catalyst beds in the hydroprocessing reactor to become plugged by either particulate contamination, or by soluble contaminants that precipitate out of solution in the vicinity of or within the catalyst beds, thus impeding the flow of material through the hydroprocessing reactor. The contamination may still be present (meaning the problem still exists) even when the Fischer-Tropsch derived hydrocarbon stream is filtered to remove particulate debris larger than about 0.1 microns.

Though not wishing to be bound by any particular theory, the inventors believe the contamination may be present (at least partly) in the Fischer-Tropsch derived hydrocarbon stream in a soluble form, and the contamination may then precipitate out of solution to form solid particulates after the stream is charged to, for example, a hydroprocessing reactor. Typically, after precipitating, the contamination forms solid plugs in the hydroprocessing reactor. Under certain conditions, the plugging occurs in a central portion of the reactor. The spatial extent of the plugging depends on hydroprocessing conditions and catalyst type, where varying space velocities, for example, can compress or spread the plugging over and/or into different regions of the reactor.

The inventors have discovered that the contamination (which may also be described as a "fouling agent" or "plugging precursor"), in both soluble and particulate forms, may be removed from the conventionally filtered Fischer-Tropsch derived product stream using an active filtering catalyst positioned upstream of the hydroprocessing zone.

Soluble contamination may be forced out of solution in the presence of an active filtering catalyst, particularly when the solution containing the soluble contamination reaches a critical temperature. In many cases the precipitation event occurs quite readily, such that the resulting solid contamination has little opportunity to enter (and hence plug) the pores and flow paths of the hydroprocessing catalyst located downstream from the active filtering zone. Forcing the precipitation event to occur upstream of the hydroprocessing zone is clearly advantageous because then precipitation does not occur within the pores of the hydroprocessing catalyst, the flow paths through the hydroprocessing beds remain open, and a pressure-drop buildup in the hydroprocessing reactor may be substantially avoided.

Embodiments of the present invention include the installation of a catalytic filtering zone positioned upstream of a hydroprocessing reaction zone. The catalytic filtering zone, which may comprise a guard bed, contains the active filtering catalyst designed to remove contamination from the filtered Fisher-Tropsch derived hydrocarbon stream. The catalytic filtering zone removes both soluble and insoluble contamination from a filtered Fischer-Tropsch derived hydrocarbon stream. Soluble contamination is forced out of solution before it has the opportunity to solidify within downstream hydroprocessing catalyst beds. In this embodiment, the active filtering catalyst is maintained at conditions (temperature and pressure, among others) at which the contamination precipitates from the solution at a desired rate.

Preferably, the active filtering catalyst is designed in such a way that the soluble contamination precipitates within the pores or openings of the active filtering catalyst, permitting the bulk of the liquid hydrocarbon stream to flow through the active filtering catalyst bed, and, as a contamination-free and purified material, into a hydroprocessing catalyst bed located downstream from the active catalyst zone. In an exemplary embodiment of the present invention, a guard bed containing active filtering catalyst is positioned upstream of the hydroprocessing zone.

Embodiments of the present invention are based at least in part on the discovery that inorganic contamination existing either in soluble form, or as ultra-fine particulates (defined herein as particulates having a size less than about 0.1 microns) may be present in a Fischer-Tropsch derived hydrocarbon stream. Furthermore, while this contamination cannot generally be removed from the hydrocarbon stream by conventional filtering, it may be removed, at least in part, by passing the contaminated stream through a guard bed comprising catalytic materials at conditions selected to remove the contamination prior to the hydroprocessing of the stream. Thus, while the guard bed comprising catalytic materials is effective at removing the contamination according to the present embodiments, there is an appropriate temperature range that serves to optimize the removal. This temperature range may not be the same as that normally used for hydroprocessing. According to the present embodiments, both catalyst filtering activity and the proper processing conditions are necessary for the active filtering zone to work effectively.

An overview of a process that utilizes an active filtering catalyst to purify a Fischer-Tropsch derived hydrocarbon stream is shown in FIG. 1. Referring to FIG. 1, a carbon source such as a natural gas 10 is converted to a synthesis gas 11, which becomes the feed 12 to a Fischer-Tropsch reactor 13. Typically, the synthesis gas 11 comprises hydrogen and carbon monoxide, but may include minor amounts of carbon dioxide and/or water. A Fischer-Tropsch derived hydrocarbon stream 14 may be conventionally filtered in a step 15 to remove particulate contamination greater than about 10 microns in size, and to produce a conventionally filtered hydrocarbon stream 16. The conventionally filtered hydrocarbon stream 16 may then optionally be passed to an acid treatment step 17, in which the filtered hydrocarbon stream 16 is contacted with a dilute aqueous acid to produce an acid treated hydrocarbon stream 18, and a spent acidic aqueous phase (not shown).

Whether or not the optional acid treatment step 17 is carried out, a hydrocarbon feed 19 (which may be either the conventionally filtered product stream 16, or the acid treated stream 18, or combinations thereof) is passed to a catalytic filtering zone 20, where contamination is removed from the conventionally filtered stream 16, 19 in the presence of an active filtering catalyst. In the case of the removal of soluble contamination, the soluble contamination is precipitated out of the filtered stream 16, 19 in the presence of the active filtering catalyst. The contamination 21 that has been removed from the filtered stream 16, 19 (which may comprise precipitated contamination that was once soluble), may be removed from the catalytic filtering zone 20, as shown in FIG. 1. Catalytically filtering the conventionally filtered hydrocarbon stream 16, 19 produces a purified hydrocarbon stream 22 suitable for hydroprocessing. The purified hydrocarbon stream 22 may then be passed to a hydroprocessing zone 23 to provide valuable fuel products 24. Optionally, the purified hydrocarbon stream 22 may undergo a filtering step 25 before being passed to the hydroprocessing zone 23.

The following disclosure will first focus on the Fischer-Tropsch process itself, and then proceed to a discussion of hydroprocessing reactors and conditions. Then the nature of contamination in general, and the specific problems associated with hydroprocessing catalyst bed plugging will be addressed, before turning to alternative embodiments of the present catalytic filtering methods.

Fischer-Tropsch Synthesis

A Fischer-Tropsch process may be carried out in the Fischer-Tropsch reactor shown schematically at reference numeral 13 in FIG. 1. The Fischer-Tropsch derived hydrocarbon stream 14 includes a waxy fraction which comprises linear hydrocarbons with a chain length greater than about $C_{20}$. If the Fischer-Tropsch products are to be used in distillate fuel compositions, they are often further processed to include a suitable quantity of isoparaffins for enhancing the burning characteristics of the fuel (often quantified by cetane number), as well as the cold temperature properties of the fuel (e.g., pour point, cloud point, and cold filter plugging point).

In a Fischer-Tropsch process, liquid and gaseous hydrocarbons are formed by contacting the synthesis gas 11 (sometimes called "syngas") comprising a mixture of $H_2$ and CO with a Fischer-Tropsch catalyst under suitable reactive conditions. The Fischer-Tropsch reaction is typically conducted at a temperature ranging from about 300 to 700° F. (149 to 371° C.), where a preferable temperature range is from about 400 to 550° F. (204 to 288° C.); a pressure ranging from about 10 to 600 psia, (0.7 to 41 bars), where a preferable pressure range is from about 30 to 300 psia, (2 to 21 bars); and a catalyst space velocity ranging from about 100 to 10,000 cc/g/hr, where a preferable space velocity ranges from about 300 to 3,000 cc/g/hr.

The Fischer-Tropsch derived hydrocarbon stream 14 may comprise products having carbon numbers ranging from $C_1$ to $C_{200+}$, with a majority of the products in the $C_5$–$C_{100}$ range. A Fischer-Tropsch reaction can be conducted in a variety of reactor types, including fixed bed reactors containing one or more catalyst beds, slurry reactors, fluidized bed reactors, or a combination of these reactor types. Such reaction processes and reactors are well known and documented in the literature.

In one embodiment of the present invention, the Fischer-Tropsch reactor 13 comprises a slurry type reactor. This type of reactor (and process) exhibit enhanced heat and mass transfer properties, and thus is capable of taking advantage of the strongly exothermic characteristics of a Fischer-Tropsch reaction. A slurry reactor produces relatively high molecular weight, paraffinic hydrocarbons when a cobalt catalyst is employed. Operationally, a syngas comprising a mixture of hydrogen ($H_2$) and carbon monoxide (CO) is bubbled up as a third phase through the slurry in the reactor, and the catalyst (in particulate form) is dispersed and suspended in the liquid. The mole ratio of the hydrogen reactant to the carbon monoxide reactant may range from about 0.5 to 4, but more typically this ratio is within the range of from about 0.7 to 2.75. The slurry liquid comprises not only the reactants for the synthesis, but also the hydrocarbon products of the reaction, and these products are in a liquid state at reaction conditions.

Suitable Fischer-Tropsch catalysts comprise one or more Group VIII catalytic metals such as Fe, Ni, Co, Ru, and Re. The catalyst may include a promoter. In some embodiments of the present invention, the Fischer-Tropsch catalyst comprises effective amounts of cobalt and one or more of the elements Re, Ru, Fe, Ti, Ni, Th, Zr, Hf, U, Mg and La on a suitable inorganic support material. In general, the amount of cobalt present in the catalyst is between about 1 and 50 weight percent, based on the total weight of the catalyst composition. Exemplary support materials include refractory metal oxides, such as alumina, silica, magnesia and titania, or mixtures thereof. In one embodiment of the present invention, the support material for a cobalt containing catalyst comprises titania. The catalyst promoter may be a basic oxide such as $ThO_2$, $La_2O_3$, MgO, and $TiO_2$, although promoters may also comprise $ZrO_2$, noble metals such as Pt, Pd, Ru, Rh, Os, and Ir; coinage metals such as Cu, Ag, and Au; and other transition metals such as Fe, Mn, Ni, and Re.

Useful catalysts and their preparation are known and illustrative, and nonlimiting examples may be found, for example, in U.S. Pat. No. 4,568,663.

Any $C_{5+}$ hydrocarbon stream derived from a Fischer-Tropsch process may be suitably treated using the present process. Typical hydrocarbon streams include a $C_5$-700° F. stream and a waxy stream boiling above about 550° F., depending on the Fischer-Tropsch reactor configuration. In one embodiment of the present invention, the Fischer-Tropsch derived hydrocarbon stream 14 is recovered directly from the reactor 13 without fractionation. If a fractionation step (not shown in FIG. 1) is performed on the products exiting the Fischer-Tropsch reactor 13, the preferred product of the fractionation step is a bottoms fraction.

Hydroprocessing of the Fischer-Tropsch Reaction Products

The product stream 14 from the Fischer-Tropsch reactor 13 may be subjected to a hydroprocessing step. This step may be carried out in the hydroprocessing reactor shown schematically at reference numeral 23 in FIG. 1. The term "hydroprocessing" as used herein refers to any of a number of processes in which the products of the Fischer-Tropsch synthesis reaction produced by reactor 13 are treated with a hydrogen-containing gas; such processes include hydrodewaxing, hydrocracking, hydroisomerization, hydrotreating, and hydrofinishing.

As used herein, the terms "hydroprocessing," "hydrotreating," and "hydroisomerization" are given their conventional meaning, and describe processes that are known to those skilled in the art. Hydrotreating refers to a catalytic process, usually carried out in the presence of free hydrogen, in which the primary purpose is olefin saturation and oxygenate removal from the feed to the hydroprocessing reactor. Oxygenates include alcohols, acids, and esters. Additionally, any sulfur which may have been introduced when the hydrocarbon stream was contacted with a sulfided catalyst is also removed.

In general, hydroprocessing reactions may decrease the chain length of the individual hydrocarbon molecules in the feed being hydroprocessed (called "cracking"), and/or increase the isoparaffin content relative to the initial value in the feed (called "isomerization"). In embodiments of the present invention, the hydroprocessing conditions used in the hydroprocessing step 23 produce a product stream 24 that is rich in $C_5$–$C_{20}$ hydrocarbons, and an isoparaffin content designed to give the desired cold temperature properties (e.g., pour point, cloud point, and cold filter plugging point). Hydroprocessing conditions in zone 23 which tend to form relatively large amounts of $C_{1-4}$ products are generally not preferred. Conditions which form $C_{20+}$ products with a sufficient isoparaffin content to lower the melting point of the wax and/or heavy fraction (such that the particulates larger than 10 microns are more easily removed via conventional filtration) are also preferred.

In some embodiments of the present invention, it may be desirable to keep the amount of cracking of the larger hydrocarbon molecules to a minimum, and in these embodiments a goal of the hydroprocessing step 23 is the conversion of unsaturated hydrocarbons to either fully or partially hydrogenated forms. A further goal of the hydroprocessing step 23 in these embodiments is to increase in the isoparaffin content of the stream relative to the starting value of the feed.

The hydroprocessed product stream 24 may optionally be combined with hydrocarbons from other sources such as gas oils, lubricating oil stocks, high pour point polyalphaolefins, foots oil (oil that has been separated from an oil and wax mixture), synthetic waxes such as normal alpha-olefin waxes, slack waxes, de-oiled waxes, and microcrystalline waxes.

Hydroprocessing catalysts are well known in the art. See, for example, U.S. Pat. Nos. 4,347,121, 4,810,357, and 6,359,018 for general descriptions of hydroprocessing, hydroisomerization, hydrocracking, hydrotreating, etc., and typical catalysts used in such processes.

Contamination and Hydroprocessing Catalyst Bed Plugging

As noted above, the Fischer-Tropsch derived hydrocarbon stream 14, 16 may cause plugging of catalyst beds in a hydroprocessing reactor due to contaminants, particulate contamination, soluble contamination, fouling agents, and/or plugging precursors present in the stream 14, 16. The terms particulates, particulate contamination, soluble contamination, fouling agents, and plugging precursors will be used interchangeably in the present disclosure, but the phenomenon will in general be referred to as "contamination," keeping in mind that the entity that eventually plugs the hydroprocessing catalyst bed may be soluble in the feed at some time prior to the plugging event. The plugging event is a result of the contamination (which eventually takes a particulate form), being filtered out of the hydroprocessing feed by the catalyst beds of the hydroprocessing reactor. According to embodiments of the present invention, a catalytic filtering step 20 is used to remove soluble contamination, fouling agents, and plugging precursors from the Fischer-Tropsch derived hydrocarbon stream 14, 16 such that plugging of the catalyst beds of the hydroprocessing reactor 23 is substantially avoided.

It may be beneficial to address contamination in general before discussing the details of the present catalytic filtration process. Contamination of the Fischer-Tropsch paraffinic product stream 14, 16 can originate from a variety of sources, and, in general, methods are known in the art for dealing with at least some of the forms of the contamination. These methods include, for example, separation, isolation, non-catalytic (conventional) filtration, and centrifugation. Inert impurities such as nitrogen and helium can usually be tolerated, and no special treatment is required.

In general, however, the presence of impurities such as mercaptans and other sulfur-containing compounds, halogen, selenium, phosphorus and arsenic contaminants, carbon dioxide, water, and/or non-hydrocarbon acid gases in the natural gas 10 or syngas 11 is undesirable, and for this reason they are preferably removed from the syngas feed before performing a synthesis reaction in the Fischer-Tropsch reactor 13. One method known in the art includes isolating the methane (and/or ethane and heavier hydrocarbons) component in the natural gas 10 in a de-methanizer, and then de-sulfurizing the methane before sending it on to a conventional syngas generator to provide the synthesis gas 11. In an alternative prior art method ZnO guard beds may be used, and may even be the preferred way to remove sulfur impurities.

It may be as important to remove particulate contamination as it is to remove the gaseous impurities enumerated above. Particulate contamination is usually addressed by conventional filtering. Particulates such as catalyst fines that are produced in Fischer-Tropsch slurry or fluidized bed reactors may be filtered out with commercially available filtering systems (in an optional filtering step 15) if the particles are larger than about 10 microns in some procedures, and larger than about one micron in others. The particulate content of the Fischer-Tropsch derived hydrocarbon stream 14, 16 (and particularly the waxy fraction thereof) will generally be small, usually less than about 500 ppm on a mass basis, and sometimes less than about 200 ppm on a mass basis. The sizes of the particulates will generally be less than about 500 microns in diameter, and often less than about 250 microns in diameter. In the context of this disclosure, to say that a particle is less than about 500 microns in diameter means that the particle will pass through a screen having a 500 micron mesh size.

The present inventors have found, however, that a significant level of contamination may remain in a Fischer-Tropsch paraffinic product stream even after conventional filtration. Such contamination typically has a high metal content. As previously disclosed, this contamination will usually lead to a plugging problem if left unchecked. A result of the plugging is a decreased hydroprocessing catalyst life.

The contaminants (including metal oxides) that are extracted from the Fischer-Tropsch derived hydrocarbon stream 14, 16, according to embodiments of the present invention, may have both an organic component as well as an inorganic component. The organic component may have an elemental content that includes at least one of the elements carbon, hydrogen, nitrogen, oxygen,; and sulfur (C, H, N, O, and S, respectively). The inorganic component may include at least one of the elements aluminum, cobalt, titanium, iron, molybdenum, sodium, zinc, tin, and silicon (Al, Co, Ti, Fe, Mo, Na, Zn, Sn, and Si, respectively).

Catalytic Filtering of a Fischer-Tropsch Derived Hydrocarbon Stream

In general, embodiments of the present invention are directed to a method of removing contamination from a Fischer-Tropsch derived product stream. In one embodiment of the present invention, a conventionally filtered hydrocarbon stream is passed to a catalytic filtering zone 20, wherein during operation, the catalytic filtering zone 20 maintains an active filtering catalyst at conditions sufficient to remove the contamination, a process which may include precipitating soluble contaminants from the filtered hydrocarbon stream.

Referring to FIG. 1, the active catalytic filtering step in zone 20 produces a purified hydrocarbon stream 22, which may then be passed to a hydroprocessing reaction zone 23, and after hydroprocessing, valuable fuel products 24 are recovered. In some embodiments, the contamination may be permitted to accumulate in the catalytic filtering zone 20 until the pressure drop across the catalytic filtering zone 20 reaches a predetermined level. At that time, the active filtering catalyst (which may now be described as "spent" or "fouled") is removed from the catalytic filtering zone 20. The fouled catalyst may be treated to remove the contamination from the catalyst, producing a regenerated catalyst, or the fouled catalyst may be discarded.

In an exemplary embodiment of the present invention, the catalytic filtering zone 20 may comprise a "guard bed," particularly in embodiments where the catalytic filtering zone 20 is located within the hydroprocessing reactor 23. Although it is known in the art to position a guard bed within a hydroprocessing reactor, such a configuration typically removes only large particulates (greater than about one micron in size) from the feed. Conventionally, guard beds are positioned toward the top of a hydroprocessing reactor. The catalytic filtering zone 20 within the hydroprocessing reactor 23 may be one of a variety of types, such as a fixed bed or trickle bed, a moving bed type which uses an on-stream catalyst replacement (OCR) system, an ebullated or expanded bed, or a slurry bed reactor.

Figure 2:
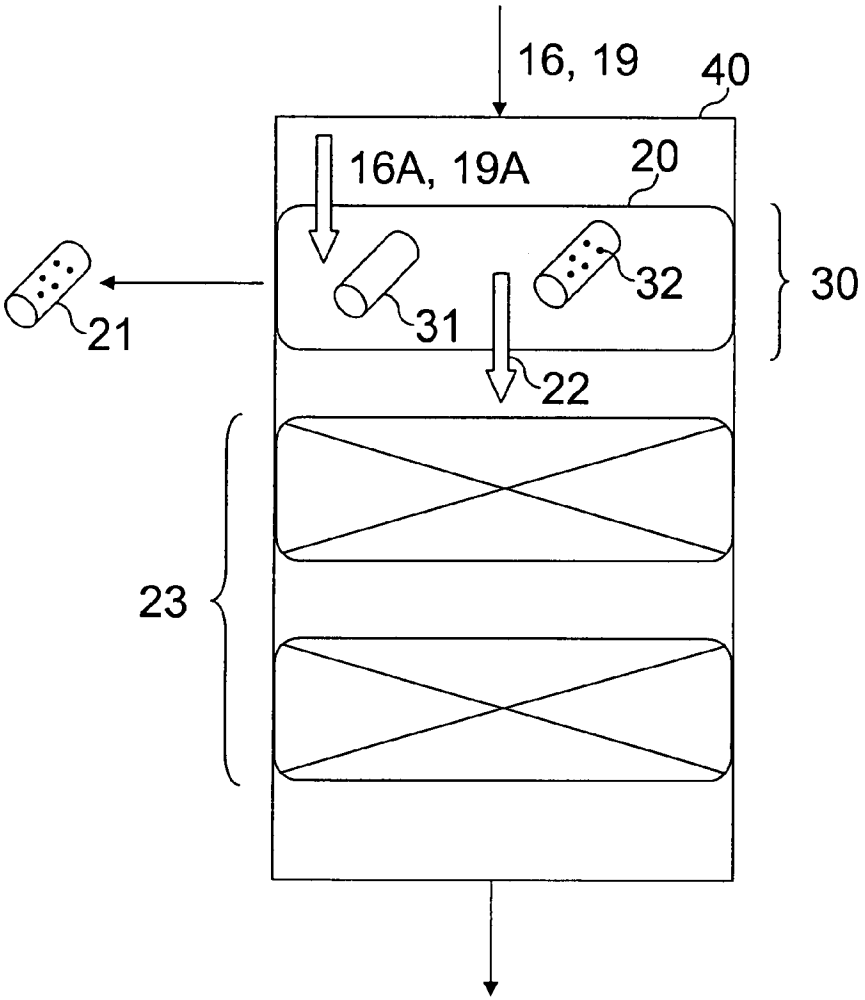
FIG. 2 shows an embodiment of the present invention in which the catalytic filtering step is conducted with an active catalyst in a catalytic filtering zone, the latter comprising a guard bed positioned within a hydroprocessing reactor.

In one embodiment, the catalytic filtering zone 20 comprises a guard bed 30 positioned within the hydroprocessing reactor, as shown in FIG. 2. The reactor is shown generally at 40, and in this configuration the reactor comprises both catalytic filtering zone 20 and hydroprocessing zone(s) 23. It should be noted that only in some of the embodiments of the present invention is the catalytic filtering zone 20 and the hydroprocessing zone 23 configured to reside within the single reactor 40; in other words, it is by no means a requirement that the catalytic filtering zone 20 and the hydroprocessing zone 23 reside within a single reactor.

The operation of an exemplary active catalyst guard bed located inside a hydroprocessing reactor will now be described with reference to FIG. 2. Referring to FIG. 2, a portion of the feed 16, 19 to the reactor 40 may contact a pellet 31 of the active filtering catalyst as part of a flow 16A, 19A. The pellet 31 may remove contamination 32 by either chemically precipitating the contamination 32 out of solution within or adjacent to the catalyst pellet, or by physically filtering the contamination 32 out of the flow 16A, 19A. In either event, the contamination 32 eventually takes a solid form, which may then be removed from the reactor 40 in any number of ways. In the exemplary embodiment depicted in FIG. 2, the precipitated and/or filtered contamination 32 remains adhered to the pellet 31, and is eventually removed from the reactor 40 as spent active filtering catalyst 21 in FIG. 2. A purified hydrocarbon stream 22 exits the guard bed/active filtering zone 20, and is passed to the hydroprocessing zone 23 of the reactor 40.

The active filtering catalytic guard bed(s) 30 of the present invention may also be used as a means to preheat the feed prior to passing it on to the hydroprocessing catalyst bed(s) 23, but generally the purified hydrocarbon stream 22 will be cooled before being passed to the hydroprocessing zone 23. The cooling medium may be hydrogen, or a hydrogen-containing gas.

Generally, the catalytic filtering guard beds of the present invention contain a particulate support material such as a refractive oxide base, alumina, silica, magnesia, and the like. The choice of material is generally based on size (a size sufficient to capture the solids without creating a pressure drop problem), availability, and cost. In general, the less expensive, the better. The support material may be in the shape of a hollow cylinder having a surface provided inside the cylinder upon which the active portion of the catalyst may be distributed. In some embodiments of the present invention, the active catalyst particulates in the catalytic filtering zone 20 may have a cross-sectional diameter ranging from about 1/50 to 0.5 inches. If the active filtering catalyst pellet 31 is in the shape of a hollow cylinder, than this dimension would correspond to the diameter of the cylinder.

In one embodiment of the present invention, the active filtering catalyst pellet 31 is configured as a hollow cyclinder comprising a refractory oxide base support material, where the support material is alumina, silica, or combinations thereof, and a coating on the inside surface of the hollow cylinder, the coating comprising at least one Group VI metal component and at least one Group VIII metal component. The Group VI metal component may comprise chromium, molybdenum, or tungsten, and combinations thereof. The Group VIII metal component may comprise iron, cobalt, nickel, ruthenium, rhodium, palladium, osmium, iridium, or platinum, and combinations thereof. One embodiment of the present invention utilizes any of the base metals iron, cobalt, nickel, and tungsten, and not the noble metals platinum and palladium.

The pore sizes in the active filtering catalyst may be tailored to specific situations. For example, a large pore size may be desirable in cases where a large capacity is needed; in other words, when the volume of the contamination whose removal is desired is large. In other embodiments, a large pore size may be indicated when a large catalyst capacity is desired, which may be the situation in reactors with guard beds that are not easily accessible, or where frequent changes of the active filtering catalyst are inconvenient. Thus, there may be many situations where large pore sizes of the active filtering catalyst are desirable. In one embodiment of the present invention, the catalyst has a peak pore diameter greater than about 165 angstroms as measured by mercury porosimetry, and an average mesopore diameter greater than about 160 angstroms. Advantageous pore sizes of such catalysts are taught by U.S. Pat. No. 4,976,848, the contents of which are herein incorporated in their entirety.

Another typically desirable design criteria of the active filtering catalyst is a high catalytic activity. A high catalytic activity causes the contaminant material to easily deposit as a solid in the guard bed, which enhances the efficiency of the guard bed, and may obviate the need for a guard bed having a thick dimension in the direction of the flow of material 16A, 19A. Furthermore, active filtering catalyst with high activity sites within its pores force the majority of the contaminant material to be deposited within the catalyst particle, allowing for a reduced overall size of the catalyst pellets. This also reduces the need for a large guard bed, and enhances the hydrodynamic flow of the feed 16A, 19A through the guard bed by directing the majority of the flow of the reacting liquid around the catalyst pellets. It is desirable that the contaminant material deposit within the pores of the catalyst uniformly throughout the catalytic filtering zone (guard bed), to ensure long processing time before a changing of the active filtering catalyst is necessary.

In cases in which the feed is expected to contain a residuum stream (i.e., a stream comprising very long chain hydrocarbons, perhaps $C_{30+}$), particularly if the stream has a high metal content, the guard bed may include active filtering catalyst having an activity specifically designed to remove these excessively large hydrocarbons. Although the $C_{30+}$ hydrocarbons would not normally be thought of as "contamination," they do have the potential for fouling/plugging hydroprocessing catalyst beds in a manner similar to that described above for contamination. To the inventors' knowledge, it was not previously known to any skilled in the art that a Fischer-Tropsch derived hydrocarbon stream could contain such metal-containing, and/or high molecular weight or polycyclic molecules, capable of fouling a hydroprocessing catalyst and plugging a hydroprocessing reactor.

The catalytic filtering zone 20 is maintained at conditions sufficient to cause the contamination to deposit on and within the pores of the active filtering catalyst. Generally, the conditions that best describe the efficiency of the deposition are temperature and pressure. In one embodiment of the present invention, the catalytic filtering zone 20 is maintained at a temperature greater than about 450° F. In another embodiment, the temperature of the catalytic filtering zone is greater than about 700° F. In some cases, it may be required to maintain the catalytic filtering zone at a temperature which is above the reaction temperature at the top of the downstream hydroprocessing reactor 23. Under these specific conditions, a cooling fluid, such as relatively cool hydrogen or the $C_5$-700° F. stream from the Fischer-Tropsch process, may be combined with the purified hydrocarbon stream 22 prior to hydroprocessing, in order to reduce the temperature of the hydrocarbon stream to the desirable temperature for hydroprocessing Another parameter that may be controlled to achieve the desired amount of contamination depositing on and within the pores of the active filtering catalyst is the pressure of the hydrogen-containing atmosphere within the catalytic filtering zone 20. In one embodiment of the present invention, the catalytic filtering zone 20 is maintained with a hydrogen-containing atmosphere at a pressure of greater than about 500 psig. In two other embodiments, the pressure of the hydrogen-containing atmosphere is greater than about 725 psig, and 1,000 psig, respectively.

In additional embodiments, the present catalytic filtering method may further include an acid treatment step that comprises contacting the filtered hydrocarbon stream 16 with an aqueous acidic stream to form a mixed stream in an acid extraction apparatus 17, and then separating the mixed stream into at least one treated hydrocarbon stream 18, and at least one spent aqueous acidic stream (not shown in FIG. 1). The acid treatment step 17 may be performed as either a batch process or a continuous process. According to these embodiments, the aqueous acid stream comprises an acid dissolved in water, and the concentration of the acid in the water may range from about 0.01 to 1.0 M. The acid used in the acid extraction step 17 may comprise hydrochloric acid, sulfuric acid, nitric acid, formic acid, acetic acid, proprionic acid, butyric acid, oxalic acid, Fischer-Tropsch derived reaction water, and combinations thereof.

EXAMPLES

The following examples illustrate various ways in which catalytic filtering of a Fischer-Tropsch derived product stream may be used to substantially avoid plugging of the catalyst beds during a subsequent hydroprocessing step. The following examples are given for the purpose of illustrating embodiments of the present invention, and should not be construed as being limitations on the scope or spirit of the instant invention.

Example 1

Catalytic Filtering of a Fischer-Tropsch Derived Hydrocarbon Stream

Figure 3:
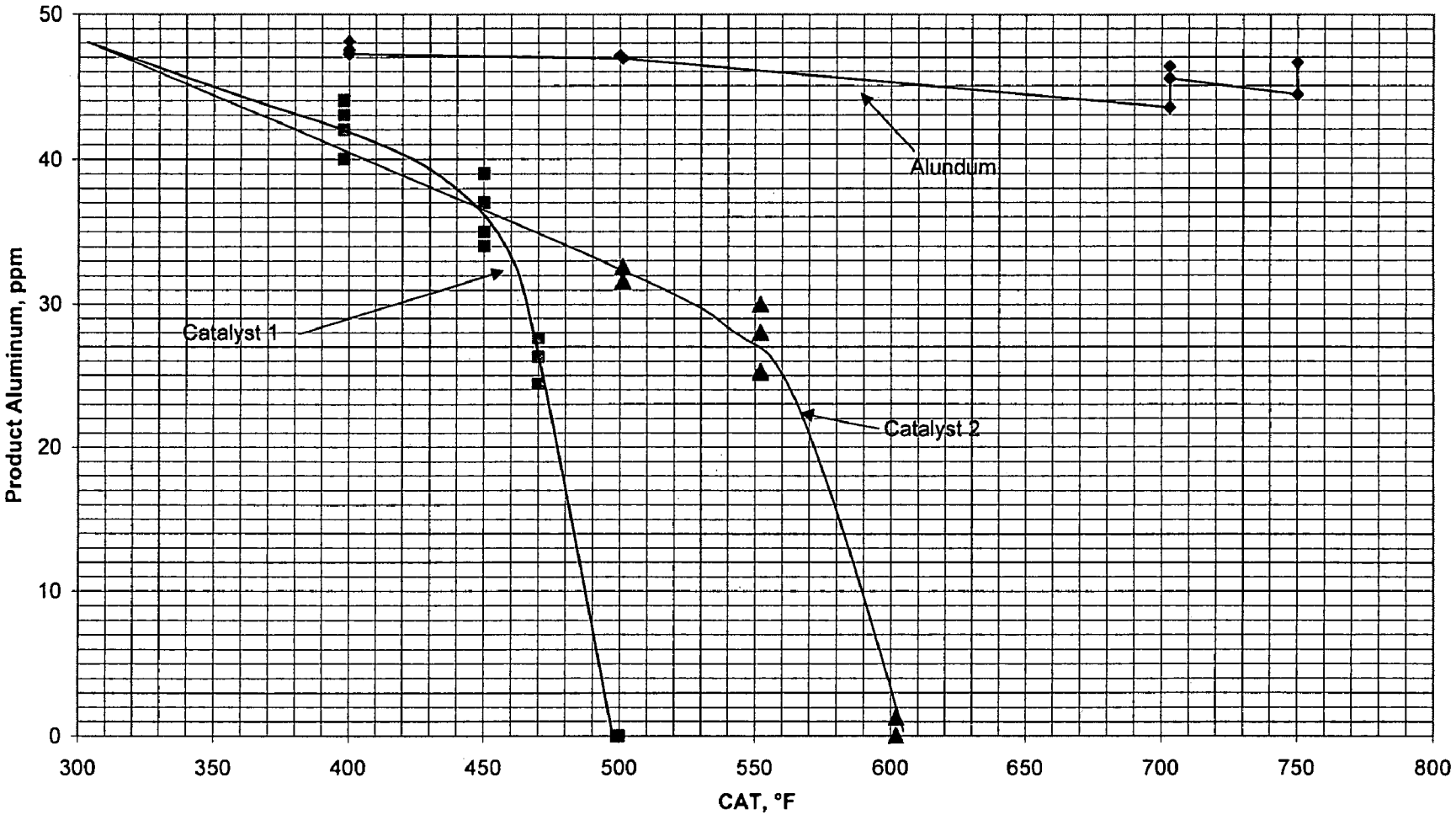
FIG. 3 is a graph of experimental results showing the benefits of purifying a Fischer-Tropsch derived hydrocarbon stream with an active filtering catalyst.

Experimental results showing the benefits of purifying a Fischer-Tropsch derived hydrocarbon feedstream with an active filtering catalyst are shown in FIG. 3. Removal of aluminum from a Fischer-Tropsch derived product stream was demonstrated by contacting a Fischer-Tropsch wax with a calcined α-alumina (defined as an alumina with substantially no hydrate content), and measuring the aluminun content of the Fischer-Tropsch wax as a function of temperature. The label of the y-axis of the graph ("product aluminum, in ppm), refers to the amount of aluminum remaining in the wax after contact with an active filtering catalyst. The label of the x-axis (CAT, in ° F.), stands for "catalyst averaged temperature," which is a temperature normalized to a given conversion. In other words, a temperature is calculated to reflect what the reaction temperature would have been to maintain a given amount of reaction conversion.

Referring to FIG. 3, the amount of aluminum removed from a Fischer-Tropsch wax by a calcined α-alumina having no catalytically active component is shown in the graph by the plot labeled "Alundum." Essentially no reduction in the aluminum content of the wax was demonstrated.

In contrast, catalysts #1 and #2 were effective in removing aluminum from the wax. Substantially all of the aluminum was removed from the wax with catalyst #2 when the reaction mixture was heated to a catalyst averaged temperature (CAT) of about 600° F.; for catalyst #1, complete removal was accomplished at about 500° F. Catalyst #1 contained more of the catalytically active metal than did catalyst #2. Catalyst #1 contained about 2% Ni and about 6% Mo, whereas catalyst #2 contained about 1% Ni and about 3% Mo, the percents being on a dry weight basis.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

What is claimed is:

1. A method of removing contamination comprising Al from a Fischer-Tropsch derived hydrocarbon stream, the method comprising:

a) filtering a Fisher-Tropsch derived hydrocarbon stream to produce a filtered hydrocarbon stream, wherein the filtered hydrocarbon stream comprises contamination comprising Al;

b) passing the filtered hydrocarbon stream to a catalytic filtering zone, the catalytic filtering zone containing a catalyst comprising at least one metal selected from the group consisting of Group VI and Group VIII elements at conditions sufficient to remove at least a portion of the contamination comprising Al from the filtered hydrocarbon stream, thus forming a purified hydrocarbon stream;

c) passing the purified hydrocarbon stream to a hydroprocessing zone; and d) recovering at least one fuel product from the hydroprocessing zone.

2. The method of claim 1, wherein the temperature of the hydroprocessing zone is less than the temperature of the catalytic filtering zone.

3. The method of claim 2, further comprising the step of cooling the purified hydrocarbon stream to produce a purified and cooled hydrocarbon stream, and passing the purified and cooled hydrocarbon stream to the hydroprocessing zone.

4. The method of claim 1, wherein the contamination originates from upstream processing equipment.

5. The method of claim 1, wherein the contamination originates from a catalyst used to produce the Fischer-Tropsch derived hydrocarbon stream.

6. The method of claim 1, wherein the size of the contamination is such that the contamination may be passed through a 1.0 micron filter.

7. The method of claim 1, wherein the catalyst has a peak pore diameter greater than about 165 angstroms as measured by mercury porosimetry, and an average mesopore diameter greater than about 160 angstroms.

8. The method of claim 1, wherein the catalyst further comprises a refractory oxide base selected from the group consisting of alumina and silica.

9. The method of claim 1, wherein the Group VI metal is selected from the group consisting of chromium, molybdenum, and tungsten, and the Group VIII metal is selected from the group consisting of iron, cobalt, nickel, ruthenium, rhodium, palladium, osmium, iridium, and platinum.

10. The method of claim 1, wherein the catalyst is configured as a hollow cylinder having an inside surface coated with the at least one Group VI or Group VIII metal.

11. The method of claim 1, wherein the catalytic filtering zone is maintained at a temperature greater than about 450° F.

12. The method of claim 11, wherein the catalytic filtering zone is maintained at a temperature greater than about 700° F.

13. The method of claim 1, wherein the catalytic filtering zone is maintained with a hydrogen-containing atmosphere having a pressure of greater than about 500 psig.

14. The method of claim 1, wherein the catalytic filtering zone and the hydroprocessing zone are configured to reside within a single reactor.

15. The method of claim 1, further including an acid treatment step that comprises contacting the filtered hydrocarbon stream with an aqueous acidic stream to form a mixed stream, and then separating the mixed stream into at least one treated hydrocarbon stream and at least one spent aqueous acidic stream.

16. The method of claim 15, wherein the acid treatment step is a batch process.

17. The method of claim 15, wherein the acid treatment step is a continuous process.

18. The method of claim 15, wherein the aqueous acid stream comprises an acid dissolved in water, the concentration of the acid in the water ranging from about 0.01 to 1.0 M.

19. The method of claim 15, wherein the acid used in the acid extraction step is selected from the group consisting of hydrochloric acid, sulfuric acid, nitric acid, formic acid, acetic acid, proprionic acid, butyric acid, oxalic acid, and Fischer-Tropsch derived reaction water.

20. The method of claim 1, wherein the contamination comprising Al is soluble in the Fischer-Tropsch derived hydrocarbon stream, ultra-fine particulates having a particle size less than 0.1 microns, or mixtures thereof.

21. The method of claim 7, wherein the contamination comprising Al deposits within the pores of the catalyst in the catalytic filtering zone to form the purified hydrocarbon stream.

22. A method of removing contamination comprising Al from a Fischer-Tropsch derived hydrocarbon stream, the method comprising:

a) filtering a Fisher-Tropsch derived hydrocarbon stream to remove contamination comprising Al having particle sizes larger than about 1 micron to produce a filtered hydrocarbon stream;

b) passing the filtered hydrocarbon stream to a catalytic filtering zone, the catalytic filtering zone containing a catalyst comprising at least one metal selected from the group consisting of Group VI and Group VIII elements at conditions sufficient to remove at least a portion of the contamination comprising Al having particle sizes less than 0.1 microns from the filtered hydrocarbon stream, thus forming a purified hydrocarbon stream;

c) passing the purified hydrocarbon stream to a hydroprocessing zone; and d) recovering at least one fuel product from the hydroprocessing zone.

* * * * *